US005437488A

United States Patent [19]

Richmond et al.

[11] Patent Number: 5,437,488

[45] Date of Patent: Aug. 1, 1995

[54] PORTABLE GOLF BALL RETRIEVER

[76] Inventors: Harvey Richmond; Janet E. Richmond, both of 5166 D Lake Catalina Dr., Boca Raton, Fla. 33496

[21] Appl. No.: 280,222

[22] Filed: Jul. 25, 1994

[51] Int. Cl.[6] ..... A63B 47/02

[52] U.S. Cl. ..... 294/19.2

[58] Field of Search ..... 294/15, 19.1, 19.2, 294/24, 26, 64.1, 65.5; 81/53.11, 53.12; 273/32 F, 162 E, DIG. 25

[56] References Cited

U.S. PATENT DOCUMENTS

| | | | |
|---|---|---|---|
| 954,927 | 4/1910 | Burdick | 294/64.1 |
| 1,830,520 | 11/1931 | Moyses | 294/19.2 |
| 2,147,907 | 2/1939 | MacChesney | 294/64.1 X |
| 2,750,222 | 6/1956 | Borah | 294/19.2 |
| 2,962,321 | 11/1960 | Fowler et al. | 294/19.2 |
| 2,983,541 | 5/1961 | Maki | 294/64.1 X |
| 3,374,027 | 3/1968 | Jacobs | 294/19.2 |
| 3,520,569 | 7/1970 | Anderson | 294/19.2 |
| 4,021,068 | 5/1977 | Piazza | 294/19.2 |
| 4,058,336 | 11/1977 | Parkinson | 294/19.2 |
| 4,659,125 | 4/1987 | Chuan | 294/19.2 |
| 4,846,515 | 7/1989 | Hall, Sr. | 294/19.2 |
| 4,944,512 | 7/1990 | Mauck et al. | 273/1 GE |
| 4,961,580 | 10/1990 | Yoe et al. | 273/1 GG |
| 4,974,894 | 12/1990 | Dubow | 294/19.2 |
| 5,165,744 | 11/1992 | Vogrin | 294/19.2 |
| 5,306,059 | 4/1994 | Pirallo | 294/64.1 X |

FOREIGN PATENT DOCUMENTS

| | | | |
|---|---|---|---|
| 2416703 | 10/1979 | France | 294/19.2 |
| 2213737 | 8/1989 | United Kingdom | 273/32 F |

*Primary Examiner*—Johnny D. Cherry
*Attorney, Agent, or Firm*—Oltman and Flynn

[57] ABSTRACT

A portable golf ball retriever is disclosed. A preferred embodiment of the retriever includes a hollow aluminum tube which has a plastic or rubber wrapped grip on one end and a rubber suction cup attached to an opposite end. The tube further includes a curved bend of approximately 45 degrees adjacent the opposite end. In an actual application, players in golf games such as Scramble can use the retriever to pickup their golf ball without having to either leave a golf cart or physically bend over. The retriever can be modified to pick up other types of balls such as tennis balls, baseballs and ping-pong balls.

5 Claims, 1 Drawing Sheet

PORTABLE GOLF BALL RETRIEVER

BACKGROUND OF THE INVENTION

Golf games continuously require players to constantly bend over and/or dismount from golf carts in order to retrieve golf balls from the ground. This problem is further aggravated from the requirements of party members playing in a golf game called Scramble. Under the rules of that game, all four members of a party individually and sequentially have to drive their golf balls off the tee. The position of the golf ball that goes the farthest is selected as the chosen position. The other party members then have to go and retrieve their golf balls and reposition them at the position of the one farthest ball(the chosen position) and then each of the members strike their balls again. When players retrieve their balls for repositioning to the chosen position, the players often have to disembark from golf carts and then physically bend over to pick up their ball. The problem becomes further exacerbated when balls are to be retrieved from undesirable areas such as water traps, sand traps, high weeds and brush where the golf player may risk injury from plants, insects and the like.

Thus, there exists a need to be able to safely and effectively be able to retrieve ground located golf balls.

SUMMARY OF THE INVENTION

The first objective of the present invention is to provide a portable handheld device for retrieving golf balls.

The second object of this invention is to provide a device for retrieving golf balls that is lightweight.

The third object of this invention is to provide a device for remotely retrieving golf balls.

The fourth object of this invention is to provide a device for retrieving golf balls without having to bend over.

The fifth object of this invention is to provide a device for retrieving golf balls that is approximately the same size as a golf club and can fit into a golf bag A preferred embodiment of the retriever includes a hollow aluminum tube of approximately 30 inches and a diameter of approximately $\frac{5}{8}$ inches which has a plastic or rubber wrapped grip on one end and a 2 inch tall rubber type suction cup attached to an opposite end. The suction cup includes a mouth portion having a diameter of approximately $1\frac{7}{8}$ inches wide and approximately $\frac{3}{8}$ to 1 inch deep for receiving one side of a golf ball that is to be picked up. The tube further includes a curved bend area of approximately 45 degrees adjacent the opposite end. In an actual application, players in golf games such as Scramble can use the retriever to pickup their golf ball without having to either leave a golf cart or physically bend over. The retriever can be modified to pick up other types of balls such as tennis balls, baseballs and ping-pong balls.

Further objects and advantages of this invention will be apparent from the following detailed description of a presently preferred embodiment which is illustrated schematically in the accompanying drawings.

DETAILED DESCRIPTION OF THE PREFERRED EMBODIMENT

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

Figure 1:
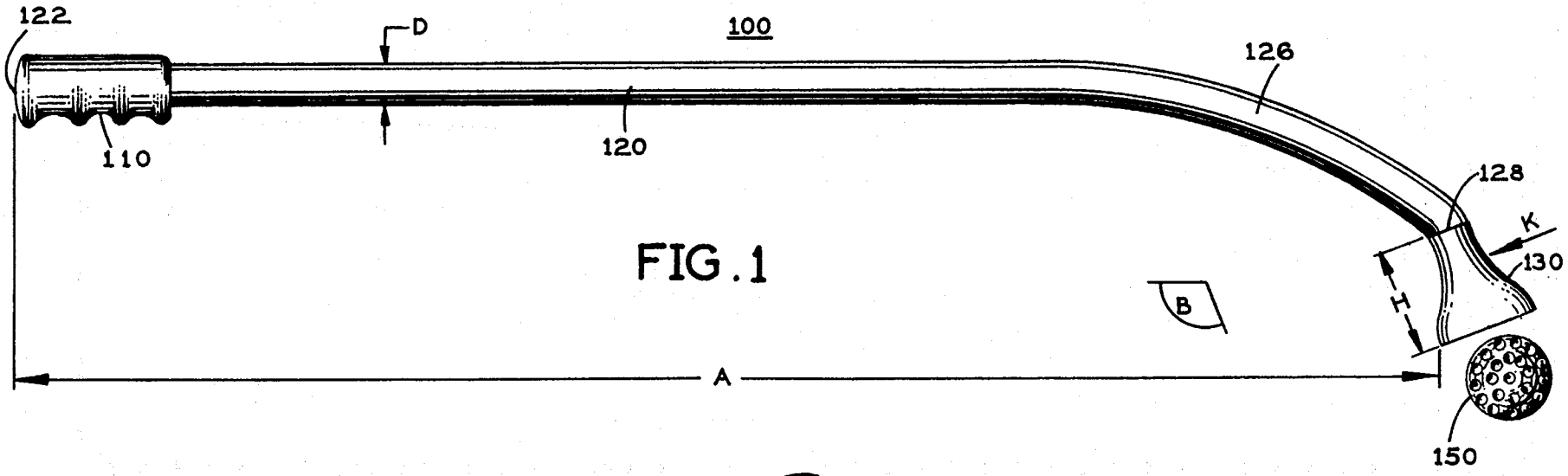
FIG. 1 shows a side view of a preferred embodiment of the invention.

FIG. 1 shows a side view of a preferred embodiment of a portable golf ball retriever 100. The device 100 includes a handle cover layer 110 such as tape, a solid cylindrical sleeve or the like. Handle 110 can be formed by known techniques such as but not limited to injection molding, tapes and the like, whose material composition can be plastic, rubber and the like. Handle 110 can be preformed with indented grooves to fit the hand of the user. The purpose of handle 110 is to apply an adequate grip for the user that prevents the entire device 100 from slipping out of the user's hand(s). Handle 110 wraps around one end 122 of a hollow tube 120, which can be formed from aluminum, plastic and the like. Tube 120 contains a bend 126 having an angle B of approximately 45 degrees near end 128. Tube 120 has a diameter, D, of approximately $\frac{5}{8}$ inch wide, and can be approximately 30 inches long, A, from end 122 to end 128. Connected at end 128 is a suction cup 130, having a height, H, of approximately 2 inches. Suction cup 130 can be attached to tube end 128 by an adhesive such epoxy, glue and the like.

Figure 2:
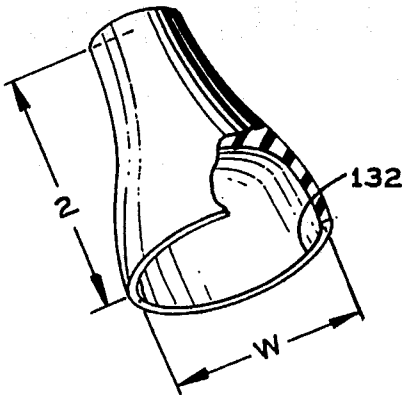
FIG. 2 shows a cut away view of the suction cup used in the invention of FIG. 1 along arrow K.

FIG. 2 shows a cut away view of the suction cup 130 used in the invention of FIG. 1. Referring to FIGS. 1 and 2, suction cup 130 can be formed from flexible rubber and the like and includes a mouth portion 132, having a diameter, W, of approximately $1\frac{7}{8}$ inches wide and a depth, d, of approximately $\frac{3}{8}$ to 1 inch deep in order to become attached to the side of a golf ball.

During a game of scramble, players who must reposition their balls during play do not have to leave their golfcarts nor physically bend over when using this invention. A player can grip device 100 by handgrip 110 and orient suction cup 130 so that mouth portion 132 overlaps a rounded side of their ball 150 for pickup.

Although the invention described herein has been described for use in a scramble golf game for retrieving golf balls, the invention would have applications to all types of games where balls need to be retrieved such as but not limited to picking up tennis balls, base balls, ping-pong balls and the like. For example, persons who practice hitting multiple tennis balls for service practice and hit plural balls during batting practice can retrieve each of those balls without having to bend over each time to pick up each individual bail. Certainly, the dimensions of the components that comprise the retriever device 100 can be reconfigured for different size balls as needed.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A portable device for allowing a person sitting in a golf cart to retrieve golf balls from the ground while staying seated in the golf cart comprising:

a golf cart occupied by a person sitting therein;

an elongated hollow tube having a first end and second end and a length of approximately thirty inches, the tube including a curved bend of approximately 45 degrees adjacent to the second end;

a gripping handle wrapped about the first end of the tube;

a suction cup having a closed end and an open end, the closed end being attached to the second end of the tube and the open end pointing away from the tube in the direction of a golf ball that needs to be picked up, wherein the person sitting in the golf cart holds the gripping handle and is able to pick up the golf ball with the open end of the suction cup while staying seated and without bending over.

2. The portable device of claim 1, wherein the gripping handle is formed from: plastic.

3. The portable device of claim 1, wherein the gripping handle is formed from: rubber.

4. The portable device of claim 1, wherein the tube includes:

a diameter approximately $\frac{5}{8}$ of an inch wide.

5. The portable device of claim 4, wherein the suction cup is:

approximately 2 inches in height with a mouth portion having a diameter of approximately $1\frac{7}{8}$ inch wide for receiving the ball therein.

* * * * *